US010648107B2

(12) United States Patent
Shiels et al.

(10) Patent No.: US 10,648,107 B2
(45) Date of Patent: May 12, 2020

(54) FABRIC CONTAINING PBI-P FIBER

(71) Applicant: PBI Performance Products, Inc., Charlotte, NC (US)

(72) Inventors: Brian P. Shiels, Charlotte, NC (US); Diane B. Hess, Gastonia, NC (US); William L. Lawson, III, Charlotte, NC (US)

(73) Assignee: PBI Performance Products, Inc., Charlotte, NC (US)

( * ) Notice: Subject to any disclaimer, the term of this patent is extended or adjusted under 35 U.S.C. 154(b) by 0 days.

(21) Appl. No.: 15/412,170

(22) Filed: Jan. 23, 2017

(65) Prior Publication Data

US 2017/0226667 A1 Aug. 10, 2017

Related U.S. Application Data

(60) Provisional application No. 62/292,496, filed on Feb. 8, 2016.

(51) Int. Cl.

| | |
|---|---|
| ***D03D 15/12*** | (2006.01) |
| ***D03D 1/00*** | (2006.01) |
| *D04B 1/22* | (2006.01) |
| *A41D 31/06* | (2019.01) |

(52) U.S. Cl.

CPC ..... *D03D 15/12* (2013.01); *D03D 1/0035* (2013.01); *A41D 31/06* (2019.02); *D04B 1/22* (2013.01); *D10B 2331/021* (2013.01); *D10B 2331/14* (2013.01); *D10B 2501/04* (2013.01)

(58) Field of Classification Search

CPC ..... A41D 2500/10; A41D 2500/20; A41D 2500/30; A41D 31/0022; D03D 1/0017; D03D 7/00

See application file for complete search history.

(56) References Cited

U.S. PATENT DOCUMENTS

| | | | | |
|---|---|---|---|---|
| 5,277,981 | A | 1/1994 | Haider et al. | |
| 5,525,436 | A | 6/1996 | Savinell et al. | |
| 5,983,409 | A | 11/1999 | Aldridge et al. | |
| 6,042,968 | A * | 3/2000 | Onorato | D06M 11/55 429/188 |
| 2002/0182967 | A1* | 12/2002 | Erb, Jr. | B32B 5/26 442/415 |
| 2006/0093870 | A1* | 5/2006 | Davis | A47C 31/001 442/334 |
| 2006/0160451 | A1* | 7/2006 | Dry | D02G 3/443 442/312 |
| 2011/0135900 | A1* | 6/2011 | Davis | A47C 31/001 428/219 |
| 2013/0227759 | A1* | 9/2013 | Schoots | D06P 3/004 2/93 |
| 2013/0254980 | A1 | 10/2013 | Underwood et al. | |
| 2013/0313192 | A1 | 11/2013 | Wang et al. | |
| 2014/0360619 | A1 | 12/2014 | Underwood et al. | |
| 2016/0040326 | A1* | 2/2016 | Okuya | D03D 15/08 139/420 R |
| 2017/0009383 | A1* | 1/2017 | Shiels | D06M 11/70 |

FOREIGN PATENT DOCUMENTS

| | | |
|---|---|---|
| JP | 2011-509354 A | 3/2011 |

OTHER PUBLICATIONS

E.J. Powers et al., "History and Development of Polymenzimidazole," Symposium on the History of High Performance Polymers—Apr. 15-18, 1986, American Chemical Society, New York.

* cited by examiner

*Primary Examiner* — Arti Singh-Pandey

(74) *Attorney, Agent, or Firm* — Hammer & Associates, P.C.

(57) ABSTRACT

A fabric for a thermal protective application includes: 5-40 weight % PBI-p fiber and the balance being conventional fibers, where the fabric has equal or better flame-resistant and/or heat-resistant properties, and a fabric weight less than an equivalent fabric made with a like amount of PBI-s fiber in place of the PBI-p fibers. The fabric for a thermal protective application includes: 5-40 weight % of a blend of PBI-p fiber and PBI-s fiber, and the balance being conventional fibers, where the fabric has equal or better flame-resistant and/or heat-resistant properties and a fabric weight less than an equivalent fabric made with a like amount of PBI-s fiber in place of the PBI-p fibers.

14 Claims, 2 Drawing Sheets

FABRIC CONTAINING PBI-P FIBER

RELATED APPLICATION

The instant application claims the benefit of U.S. Provisional Patent Application Ser. No. 62/292,496 filed Feb. 8, 2016.

FIELD OF THE INVENTION

The instant invention is directed to a fabric made with a phosphonated polybenzimidazole (PBI-p) fiber.

BACKGROUND OF THE INVENTION

In the article, *History and Development of Polybenzimidazole* by E. J. Powers and G. A. Serad (presented on Apr. 15-18, 1986 and published in *High Performance Polymers: Their Origin and Development*), it is disclosed that a polybenzimidazole (PBI) polymer with 27 wt. % phosphoric acid ($H_3PO_4$) absorbed (or pick-up) may have utility as a very thermo-oxidatively stable fiber, pages 19-20 and Table XIII. Powers & Serad teach that the phosphonated PBI is made by soaking PBI films in 2% aqueous phosphoric acid, page 20.

Polybenzimidazole fibers, that have been commercially offered up until this time, are sulfonated, i.e., the fibers, after spinning, are treated with 20 wt. % aqueous sulfuric acid ($H_2SO_4$) which results in a 24 wt. % APU (Acid Pick-Up) sulfonated PBI fiber (PBI-s). This sulfonated PBI fiber has met with great commercial success in, for example, fire fighter's turnout gear, because it has an LOI (limiting oxygen index, ASTM D2863) of around 41%.

The commercial introduction of phosphonated polybenzimidazole (PBI-p) fiber is currently being explored. PBI-p fibers are discussed in U.S. patent application Ser. No. 15/193,206 filed Jun. 27, 2016, incorporated herein by reference. It is hoped that these new PBI-p fibers will enable a new class of lighter weight fabrics with greater flame-resistant and heat-resistant properties than those fabrics previously commercialized with PBI-s fibers alone. For example, these new PBI-p fabrics may be used in fire fighter's turnout gear. The new fabric may enable the turnout gear to be lighter weight and provide equivalent or better protection for the fire fighters.

In some thermal protective applications, for example, fire fighter's turnout gear, fabrics with less weight but the same or better flame-resistant and/or heat-resistant properties are desired. Currently, when a fire fighter dies in the line of duty, the cause of death is more likely to be some sudden cardiac event brought on by heat stress than death attributable to the actual fire. The heat stress may be reduced by lighter weight garments. But, fire fighters still want the same flame protection. Hence, the search for new fabrics for the garment that weigh less, but have the same or better flame-resistant and/or heat-resistant properties.

Accordingly, there is a need for new fabrics having lighter weights and equivalent or better flame-resistant and/or heat-resistant properties than those currently available, and those new fabrics may be made with PBI-p fibers.

DESCRIPTION OF THE DRAWINGS

Referring to the drawings, where like numerals indicate like elements, there is shown in FIGS. 1 and 2 views of the Dynamic Flame Kit (DFK) used in the Dynamic flame test.

SUMMARY OF THE INVENTION

Figure 1:
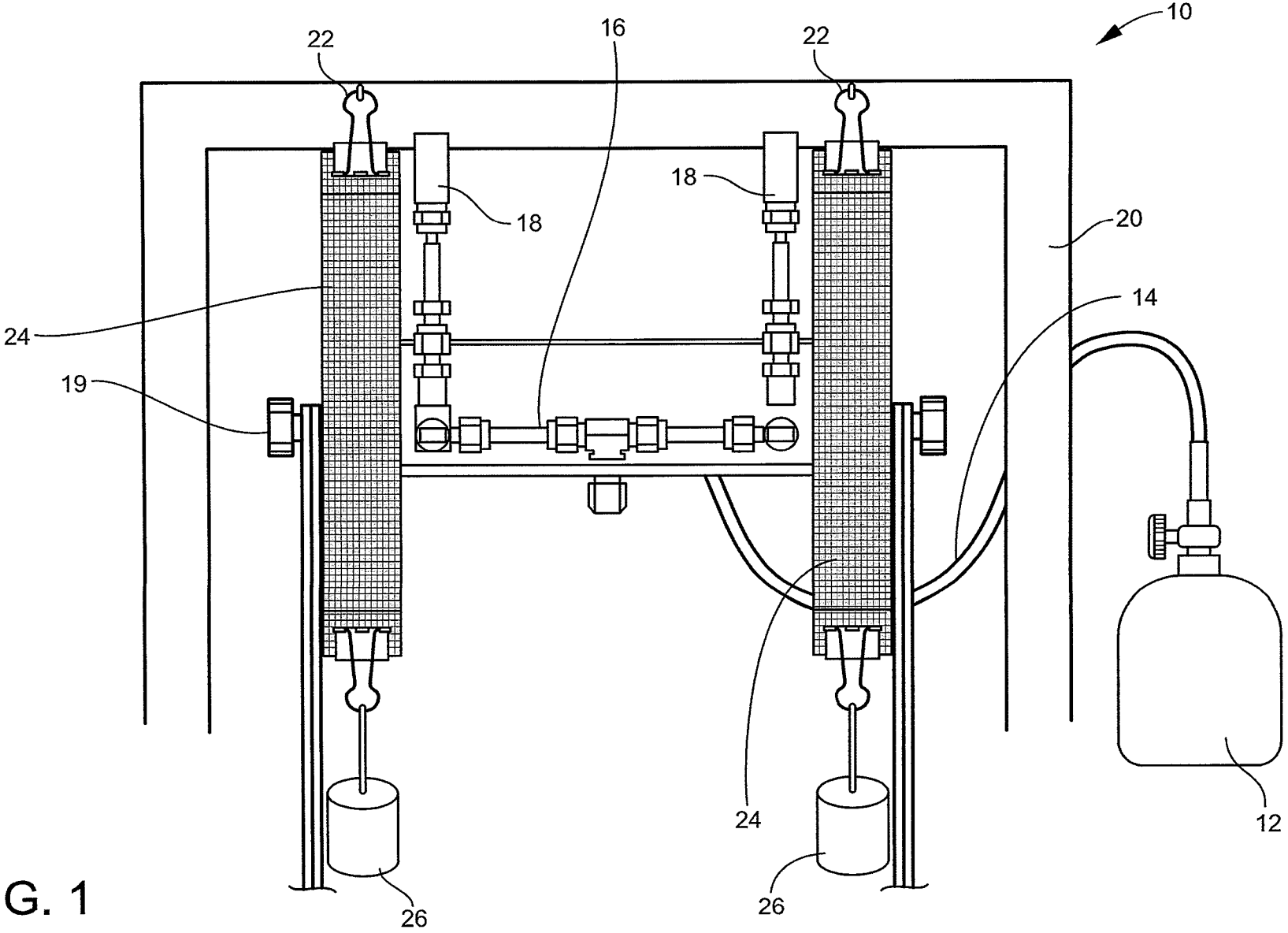

A fabric for a thermal protective application includes: 5-40 weight % PBI-p fiber and the balance being conventional fibers, where the fabric has equal or better flame-resistant and/or heat-resistant properties, and a fabric weight less than an equivalent fabric made with a like amount of PBI-s fiber in place of the PBI-p fibers. The fabric for a thermal protective application may include: 5-40 weight % of a blend of PBI-p fiber and PBI-s fiber, and the balance being conventional fibers, where the fabric has equal or better flame-resistant and/or heat-resistant properties and a fabric weight less than an equivalent fabric made with a like amount of PBI-s fiber in place of the PBI-p fibers.

DETAILED DESCRIPTION OF THE INVENTION

The fabric may be characterized, in one embodiment as, has having 5-40 weight % PBI-p fiber and the balance being other conventional fibers, where the fabric has equal or better flame-resistant and heat-resistant properties and a fabric weight (e.g., basis or areal weight–osy [ounces per square yard] or gsm [grams per square meter]) less than an equivalent fabric made with a like amount of PBI-s fiber in place of the PBI-p fibers. The fabric may be characterized, in another embodiment as, has having 5-40 weight % of a blend of PBI-p fiber and PBI-s fiber, and the balance being other conventional fibers, the amount of PBI-s fiber being greater than the amount of PBI-p fiber, where the fabric has equal or better flame-resistant and heat-resistant properties and a fabric weight (e.g., basis or areal weight–osy [ounces per square yard] or gsm [grams per square meter]) less than an equivalent fabric made with a like amount of PBI-s fiber in place of the PBI-p fibers.

Fabric, as used herein, refers to any fabric. A fabric may be a woven fabric, a knit fabric, a nonwoven fabric, or a combination thereof. The fabric may have any weight (e.g., basis or areal weight–osy [ounces per square yard] or gsm [grams per square meter]). In some embodiments, the fabric weight may be in the range of 1.0-6.5 osy (and all or any subsets included therein). In some embodiments, the lower end of the fabric weight (osy) range may be: 1.0, 1.25. 1.5, 1.75, 2.0, 2.25, 2.5, 2.75, 3.0, 3.25, 3.5; 3.75, 4.0, 4.25, 4.5, 4.75, and 5.0. In some embodiments, the upper end of the fabric weight (osy) range may be: 6.5, 6.25, 6.0, 5.75, 5.5, 5.25, 5.0, 4.75, 4.5. In some embodiments directed to woven fabrics, the fabric may have a weight in the range of 4.0-6.5 osy, or in a range of 4.5-6.0 osy, or 4.75-6.0 osy.

The fabric may be used in any application (or end use). The fabric may be used in thermal protective applications. Exemplary thermal protective applications include, but are not limited to: fire fighter's turnout gear, tents, arc-flash protective gear, automotive applications, automotive gear, spacesuits, space vehicles, and electronic equipment.

Fibers, as used herein, refer to any fiber. Fibers may be staple (or short cut lengths) or filament (or fiber length>>fiber diameter or infinite length). Fibers may have any weight (e.g., denier or TEX).

PBI-p fibers refer to PBI fibers phosphonated with phosphoric acid in the range of 4-30 wt. % (or 4-30% phosphoric acid pick up (APU)). Phosphoric acid (aqueous) concentration may range from ≥10-85 wt. %; further details on acid concentration and APU may be found in, for example, U.S. Ser. No. 15/193,206 filed Jun. 27, 2016, incorporated herein by reference. The PBI-p fiber has higher thermo-oxidative stability as compared to commercially available sulfonated PBI fibers. The phosphoric acid range includes any and all sub-ranges included therein. In another embodiment, the PBI-p fiber has a phosphoric acid (APU) in the range of 5-25 wt. %. In still another embodiment, the PBI-p fiber has a phosphoric acid (APU) in the range of 6-20 wt. %. In yet another embodiment, the PBI-p fiber has a phosphoric acid (APU) of about 18 wt. %. The upper end of the phosphoric acid range may be: 30, 29, 28, 27, 26, 25, 24, 23, 22, 21, 20, 19, 18, 17, 16, 15, 14, 13, 12, 11, and 10. In another embodiment, the PBI-p fibers may have an LOI of 60+%. LOI, or Limiting Oxygen Index, is measured by ATSM D2863. LOI is a fiber property and not a fabric property. Accordingly, one may obtain a thermo-oxidatively stable fiber without a 27 wt. % phosphoric acid pick-up. This may be important because of the negative implications associated with phosphates in the environment. The PBI-p fiber may have a weight in the range of 1.0-2.0 denier per filament (dpf), and in one embodiment, the fiber weight may be 1.5 dpf.

PBI-s fibers refer to the commercially available FBI fibers that are currently available from FBI Performance Products, Inc. of Charlotte, N.C.

Conventional fibers, as used herein refer to any conventional fiber. In one embodiment, these conventional fibers refer to natural and synthetic fibers. The conventional fibers may or may not be treated with a flame retardant (FR treated). Natural fibers may be cotton and/or wool. Synthetic fibers may be made of, for example, polyolefin (e.g., polyethylene, polypropylene, and the like), polyamide (e.g., nylon and the like), acrylic (and/or modacrylic), polyester (e.g., PET, PBT, PEN), aramid (e.g., meta-aramid, para-aramid), cellulosic (e.g., rayon, Lyocel), carbon, polybenzoxazole (PBO), melamine, polyamide imide, polyimide, polyphenyl sulfide (PPS), polyflouride (e.g., PTFE), poly ether ketone (e.g., PEK, PEEK, PEEKK, PEKK, and the like), and combinations and blends thereof.

The fibers are spun into yarns by any conventional means. The yarns may be made of a single fiber or blends of fibers. Exemplary blends include, but are not limited to, PBI-p fibers and conventional fibers, or PBI-p, PBI-s, and conventional fibers, and the like. The yarns may include PBI-p in the weight range of 5-40% of the fabric. Yarns with a blend of PBI-p fiber and PBI-s fiber may have a PBI-p:PBI-s weight ratio in the range of 20-100:0-80. In one embodiment, the yarn may be a blend of PBI-p and aramid (e.g., para-aramid) with exemplary weight ratios of 5-40 wt % PBI-p and 60-95 wt % aramid e.g., para-aramid). In another embodiment, the yarns may be blend of PBI-p, PBI-s, and aramid (e.g., para-aramid) with exemplary weight ratios of, for example, 7-40:0-33:60 or 10-40:0-30:60 (PBI-p:PBI-s: aramid (e.g., para-aramid)).

The fabric, in one embodiment, may have PBI-p fibers in the weight range of about 5-40% based on the fabric weight. The fabric, in another embodiment may have a blend of PBI-p and PBI-s fibers in a weight range of about 5-40% based on the fabric weight. In one embodiment, the fabric may be a blend of PBI-p and aramid (e.g., para-aramid) with exemplary weight ratios of 5-40 wt % PBI-p and 60-95 wt % aramid. In another embodiment, the fabric may be blend of PBI-p, PBI-s, and aramid (e.g., para-aramid) with exemplary weight ratios of, for example, 7-40:0-33:60 or 10-40:0-30:60 (PBI-p:PBI-s: aramid (e.g., para-aramid)).

The fabric made with the PBI-p fibers, in one embodiment, may have a lesser weight (e.g., basis or areal weight–osy [ounces per square yard] or gsm [grams per square meter]) and equivalent or better flame-resistant and heat-resistant properties than an equivalent fabric made with a like amount of PBI-s fiber. For example, a first fabric is made with X % by weight PBI-s and conventional fibers will have a given weight (e.g., basis or areal weight–osy [ounces per square yard] or gsm [grams per square meter]) and given flame-resistant and heat-resistant properties (discussed in greater detail below) and a second fabric made with X % by weight PBI-p fiber and the same conventional fibers as the first fabric, the second fabric will weigh less than the first fabric and have equivalent or better flame-resistant and heat-resistant properties.

Flame-resistant and heat-resistant properties may be any such conventional properties. Exemplary flame-resistant, or flammability, (FR) properties may include, but are not limited to: Dynamic Flame Test—see discussion below; Vertical Flame Test—ASTM D6413; Thermal Protective Performance (TPP)—NFPA1971/ISO17492; and Ball Burst (ASTM D3787) After TPP exposure (ISO17492); and combinations thereof. In one embodiment, the flame-resistant property may be the Dynamic Flame Test. Exemplary heat-resistant (HR) properties may include, but are not limited to: Thermal Shrinkage—ASTM F2894/ISO17493; and combinations therewith.

Figure 2:
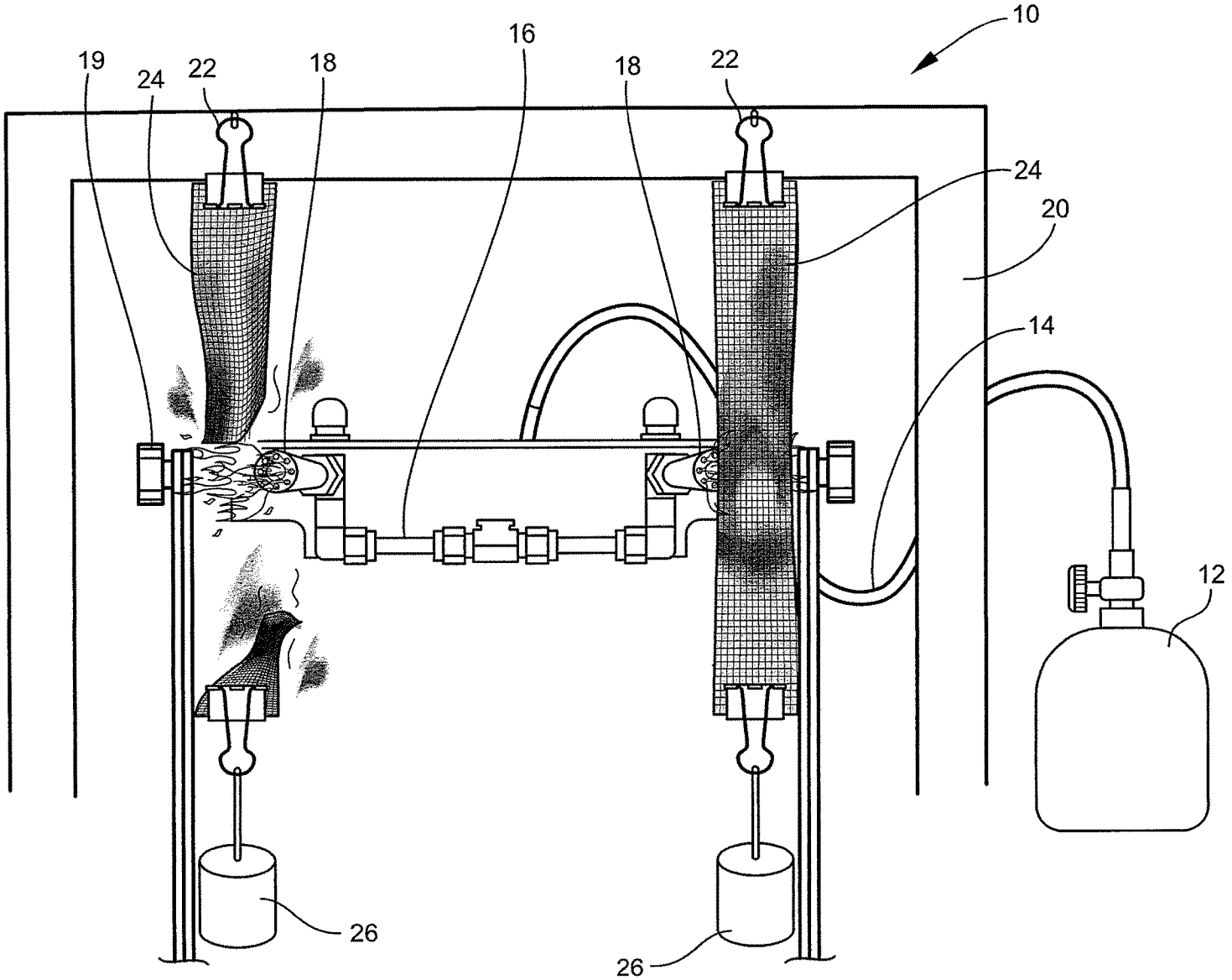

The Dynamic Flame test is explained, with reference to FIGS. 1 and 2, as follows:

The Dynamic Flame test uses the Dynamic Flame Kit (DFK) shown in FIGS. 1 and 2. The DFK 10 generally includes: a propane source 12, a propane distribution manifold 16 with two identical burners 18 and a knob 19, and a propane tube 14 interconnecting the source 12 with the distribution manifold 16 and burners 18, and a fabric frame 20 with clips 22 for holding fabric strips 24 and weights 24 (e.g., 225 g) at the bottom ends of the fabric strips 24. In a first position, FIG. 1, the burners 18 are in a vertical, or upright, position (flame not pointed at fabric strip 24). In a second position, FIG. 2, the burners 18 are in a horizontal, or engaged, position (flame pointed at the fabric strip 24).

The Dynamic Flame test is conducted as follows: assemble the DFK; connect a new propane bottle 12 to tubing 14; ignite a first burner 18 and then the second burner 18; allow the burners 18 to warm-up for a minimum of 5 minutes; prepare fabric strips (control and test strips), 1" width and 8" long and condition them under the same conditions; attach the conditioned fabric strips 24 to the fabric frame 20 by folding about ½" of the top of the strip and fastening the folded edge to the fabric frame 20 with the clip 22 (e.g., binder clip); attach the weight 26 to the lower end of the fabric strip 24; ensure that the clip 22 position are the same between the strips 24 being tested and that from test to test the clip 22 position is the same, also ensure that the flame is aligned the same for both test strips 24 and between tests; at the start of the test make sure each strip 24 is motionless; quickly rotate (using knob 19) the burners 18 from the first position to the second position and simultaneously start the timer; when the weight 26 drops, stop the timer and record the time; repeat with new samples nine (9) time for a total of ten (10) replicates; and report the average of times of the ten tested samples.

EXAMPLES

In the following examples, data presented in the tables compares fabrics made with PBI-s fibers to fabrics made with PBI-p fibers. In each table, the compared fabrics are identical and are made by identical processes, the only difference being one fabric is made with PBI-s fiber and the other is made with PBI-p fiber. Table 1 lists data according to testing done for fabrics marketed to the international market; while Tables 2 and 3 list data according to testing done for fabrics marketed to the domestic (or US) market.

TABLE 1

(nominal 6 osy fabric)

| | | Test Description/Conditions | | | |
|---|---|---|---|---|---|
| | | Control (PBI-s) | | Invention (PBI-p) | |
| | | Composition | | | |
| | | 65% p-aramid/35% PBI-s | | 65% p-aramid/35% PBI-p | |
| | | weave | | | |
| | | filament twill | | filament twill | |
| | | Basis Weight | | | |
| | | osy | gsm | osy | gsm |
| ASTM D3776 | as received (AR) | 5.99 | 203 | 5.68 | 192 |
| | 5x wash | 6.21 | 211 | 5.78 | 196 |
| | 10x wash | 6.37 | 216 | 5.87 | 199 |
| Laundry Shrinkage | 5x wash | 2.77 × +0.88 | | 1.97 × +0.9 | |
| % W × F | 10x wash | 4.2 × +0.33 | | .16 × +1.17 | |
| ISO 6330 4M | | | | | |
| Thermal shrinkage | 260° C. - 5 min | 1.67 × 0.0 | | 0.88 × +0.5 | |
| ISO 17493 | | | | | |
| Tear Strength (Trapezoid Tear) | | Lbs. | Newtons | Lbs. | Newtons |
| W × F | as received (AR) | 158.1 × 159.7 | 703 × 710 | 164.5 × 236.7 | 732 × 1053 |
| ASTM D5587 | 5x wash | 183.9 × 235.3 | 818 × 1047 | 114.2 × 202.2 | 508 × 899 |
| NFPA (5 highest peaks) | 10x wash | 165.5 × 233.6 | 736 × 1039 | 131.7 × 212.1 | 586 × 944 |
| Tensile (2 inch strip) | as received (AR) | 497.7 × 475.6 | 2214 × 2116 | 600.0 × 508.4 | 2668 × 2263 |
| W × F | 5x wash | 430.5 × 512.1 | 1915 × 2278 | 523.3 × 550.7 | 2327 × 2450 |
| ISO 13934-1 | 10x wash | 415.3 × 483.6 | 1847 × 2151 | 478.5 × 538.0 | 2128 × 2393 |
| Tensile (TPP Residual Strength) | as received (AR) | 497.7 | 2214 | 600 | 2669 |
| 2 inch strip - (Warp only) | 2 sec | 516 | 2295 | 556.7 | 2476 |
| ISO 17492 @ 84 kw heat flux | 4 sec | 409.5 | 1822 | 306.5 | 1363 |
| ISO 13934-1 | 6 sec | 309.1 | 1375 | 180.1 | 801 |
| | 8 sec | 137.1 | 610 | 84.2 | 375 |
| Tensile (Grab) | as received (AR) | 347.1 × 383.6 | 1544 × 1706 | 361.1 × 370.0 | 1606 × 1646 |
| W × F | 5x wash | 331.3 × 365.6 | 1474 × 1626 | 328.7 × 382.8 | 1462 × 1703 |
| ISO 13934-2 | 10x wash | 340.7 × 378.5 | 1516 × 1684 | 338.9 × 377.2 | 1508 × 1678 |
| Tear Strength (Trouser Tear) | as received (AR) | 61.1 × 50.3 | 272 × 224 | 60.7 × 63.5 | 270 × 283 |
| ISO 13937-2 | | | | | |
| Ball Burst Strength | as received (AR) | 464.9 | 2068 | 660.8 | 2939 |
| ASTM D3787 | AR + 8 sec TPP | 69.1 | 307 | 44.9 | 200 |
| | 5x wash (W) | 508.3 | 2261 | 635.3 | 2826 |
| | 5 × W + 8 sec TPP | 82.9 | 369 | 32.7 | 145 |
| | 10x wash | 496 | 2206 | 664.9 | 2958 |
| | 10 × W + 8 sec TPP | 89.8 | 399 | 32.2 | 143 |
| Vertical Flame | afterflame sec. | 0 × 0 | | 0 × 0 | |
| ASTM D6413 | afterglow sec. | 9.04 × 6.04 | | 2.99 × 3.00 | |
| | char length in. | .66 × .43 | | .75 × .90 | |
| Dynamic Flame as received | seconds W × F | 23.5 × 22.6 | | 36.6 × 35.0 | |
| Abrasion Resistance (Taber) | | | | | |
| H-18/500 g/w vac | Cycles to 1st hole | >400 | | >400 | |
| ASTM D3884 | | | | | |
| Thermal Protective Performance (TPP)/ | TPP rating* | 35.92 | | 36.23 | |
| Heat Transfer Index (HTI) | | | | | |
| ISO 17492 TPP + HTI | HTI24* | 19.62 | | 19.66 | |
| | HTI12* | 14.3 | | 14.34 | |
| | HTI 24-12* | 5.32 | | 5.32 | |

*Composite Materials: Bristol Q01 Thermal Liner, Gore Fireblocker Moisture Barrier

TABLE 2

(nominal 5.5 osy fabric)

| | | Test Description/Conditions | | | |
|---|---|---|---|---|---|
| | | Control (PBI-s) | | Invention (PBI-p) | |
| | | Composition | | | |
| | | 60% p-aramid/40% PBI-s | | 60% p-aramid/40% PBI-p | |
| | | weave | | | |
| | | ripstop | | ripstop | |
| | | Basis Weight | | | |
| | | osy | gsm | osy | gsm |
| ASTM D3776 | as received (AR) | 5.67 | 192 | 5.65 | 192 |
| | 5x wash | 5.93 | 201 | 6.08 | 206 |
| | 10x wash | 6.11 | 207 | 6.33 | 215 |
| Laundry Shrinkage | 5x wash | 3.50 × 1.08 | | 1.75 × 1.67 | |
| % W × F | 10x wash | 4.25 × 2.00 | | 4.67 × 2.5 | |
| AATCC 135:1, V, Ai | | | | | |
| Thermal shrinkage | 260° C. - 5 min | 3.0 × 1.0 | | 1.5 × 0.3 | |
| ASTM F2894 | | | | | |
| Tear Strength (Trapezoid Tear) | | Lbs. | Newtons | Lbs. | Newtons |
| W × F | as received (AR) | 28.3 × 22.1 | 126 × 98 | 35.9 × 29.3 | 160 × 130 |
| ASTM D5587 | 5x wash | 25.8 × 19.5 | 115 × 87 | 31.9 × 27.5 | 142 × 122 |
| NFPA (5 highest peaks) | 10x wash | 25.9 × 18.3 | 115 × 81 | 28.9 × 25 | 129 × 111 |
| Tensile (2 inch strip) | as received (AR) | 451.9 × 308.1 | 2010 × 1370 | 501.1 × 385.4 | 2229 × 1714 |
| W × F | 5x wash | 397.9 × 272.4 | 1770 × 1212 | 459.7 × 370.4 | 2045 × 1648 |
| ASTM D5035 | 10x wash | 359.9 × 286.6 | 1601 × 1275 | 432.4 × 341.0 | 1923 × 1517 |
| Tensile (TPP Residual Strength) | as received (AR) | 451.9 | 2010 | 501.1 | 2229 |
| 2 inch strip - (Warp only) | 2 sec | 251 | 1116 | 227.5 | 1012 |
| ISO 17492 @ 84 kw heat flux | 4 sec | 138.7 | 617 | 174.8 | 778 |
| ASTM D5035 | 6 sec | 135.1 | 601 | 102.5 | 456 |
| | 8 sec | 64.8 | 288 | 50.7 | 226 |
| Tensile (Grab) | as received (AR) | 275 × 185.8 | 1223 × 826 | 327.5 × 227.9 | 1457 × 1014 |
| W × F | 5x wash | 249.5 × 165.8 | 1110 × 738 | 293.1 × 205.2 | 1304 × 913 |
| ASTM D5034 | 10x wash | 233.8 × 161.1 | 1040 × 717 | 278.9 × 206.5 | 1241 × 919 |
| Ball Burst Strength | as received (AR) | 377.3 | 1678 | 459.5 | 2044 |
| ASTM D3787 | AR + 10 sec TPP | 28.3 | 126 | 14.1 | 63 |
| | 5x wash(W) | 273.6 | 1217 | 429.1 | 1909 |
| | 5 × W + 10 sec TPP | 22.3 | 99 | 13.3 | 59 |
| | 10x wash | 260.6 | 1159 | 371 | 1650 |
| | 10 × W + 10 sec TPP | 15.7 | 70 | 15.4 | 69 |
| Vertical Flame | afterflame sec. | 0 × 0 | | 0 × 0 | |
| ASTM D6413 | afterglow sec. | 1.97 × 1.87 | | 1.12 × 1.17 | |
| | char length in. | 0.92 × 0.72 | | 0.7 × 0.54 | |
| Dynamic Flame as received | seconds W × F | 37.3 × 37.2 | | 47.7 × 48.5 | |
| Abrasion Resistance (Taber) | | | | | |
| H-18/500 g/w vac | cycles to first hole | 433 | | 465 | |
| ASTM D3884 | | | | | |
| Thermal Protective Performance (TPP) | | | | | |
| ISO 17492 TPP | TPP Rating** | 34.17 | | 36.3 | |

**Composite Materials: Glide w/PBI G2 Thermal Liner, Stedair Gold Moisture Barrier

TABLE 3

(nominal 5 osy fabric)

| | | Test Description/Conditions | | | |
|---|---|---|---|---|---|
| | | Control (PBI-s) | | Invention (PBI-p) | |
| | | Composition | | | |
| | | 60% p-aramid/40% PBI-s | | 60% p-aramid/40% PBI-p | |
| | | weave | | | |
| | | ripstop | | ripstop | |
| | | Basis Weight | | | |
| | | osy | gsm | osy | gsm |
| ASTM D3776 | as received (AR) | 4.92 | 167 | 4.80 | 163 |
| | 5x wash | 5.07 | 172 | 5.19 | 176 |
| | 10x wash | 5.12 | 174 | 5.28 | 179 |

TABLE 3-continued

| (nominal 5 osy fabric) | | | | | |
|---|---|---|---|---|---|
| Laundry Shrinkage | 5x wash | 5.5 × 0.0 | | 3.7 × 0.0 | |
| % W × F | 10x wash | 6.1 × 1.0 | | 4.9 × 0.0 | |
| AATCC 135:1, V, Ai | | | | | |
| Thermal shrinkage | 260° C. - 5 min | 2.4 × 0.5 | | 1.6 × 0.0 | |
| ASTM F2894 | | | | | |
| Tear Strength (Trapezoid Tear) | | Lbs. | Newtons | Lbs. | Newtons |
| W × F | as received (AR) | 23.0 × 13.5 | 102 × 60 | 27.9 × 16.6 | 124 × 74 |
| ASTM D5587 | 5x wash | 21.8 × 12.9 | 97 × 57 | 25.6 × 14.1 | 114 × 63 |
| NFPA (5 highest peaks) | 10x wash | 21.7 × 11.3 | 97 × 50 | 23.3 × 12.3 | 104 × 55 |
| Tensile (2 inch strip) | as received (AR) | 380.6 × 248.6 | 1693 × 1106 | 419.4 × 249.3 | 1866 × 1109 |
| W × F | 5x wash | 341.5 × 217.2 | 1519 × 966 | 400.7 × 217.4 | 1782 × 967 |
| ASTM D5035 | 10x wash | 353.7 × 212.4 | 1573 × 945 | 387.9 × 205.9 | 1725 × 916 |
| Tensile (TPP Residual Strength) | as received (AR) | 380.6 | 1693 | 419.4 | 186 |
| 2 inch strip - (Warp only) | 2 sec | 170 | 756 | 185.7 | 826 |
| ISO 17492 @ 84 kw heat flux | 4 sec | 136 | 605 | 138.4 | 616 |
| ASTM D5035 | 6 sec | 103.2 | 459 | 97.9 | 435 |
| | 8 sec | 50.4 | 224 | 47.1 | 210 |
| Tensile (Grab) | as received (AR) | 254.3 × 156.8 | 1131 × 697 | 282.7 × 149.3 | 1258 × 664 |
| W × F | 5x wash | 225.8 × 139.4 | 1004 × 620 | 238.1 × 130.7 | 1059 × 581 |
| ASTM D5034 | 10x wash | 222.8 × 129.6 | 991 × 576 | 249.3 × 144.0 | 1109 × 641 |
| Ball Burst Strength | as received (AR) | 180.1 | 801 | 269.9 | 1201 |
| ASTM D3787 | AR + 10 sec TPP | 9.4 | 42 | 11 | 49 |
| | 5x wash(W) | 187.1 | 832 | 239.2 | 1064 |
| | 5 × W + 10 sec TPP | 14.1 | 63 | 7.2 | 32 |
| | 10x wash | 181.4 | 807 | 203.7 | 906 |
| | 10 × W + 10 sec TPP | 14.5 | 64 | 9.9 | 44 |
| Vertical Flame | afterflame sec. | 0 × 0 | | 0 × 0 | |
| ASTM D6413 | afterglow sec. | 3.1 × 3.9 | | 1.3 × 2.5 | |
| | char length in. | 0.9 × 0.5 | | 0.6 × 0.2 | |
| Dynamic Flame as received | seconds W × F | 25.0 × 35.0 | | 53.6 × 53.3 | |
| Abrasion Resistance (Taber) | | | | | |
| H-18/500 g/w vac | cycles to first hole | 460 | | 297 | |
| ASTM D3884 | | | | | |
| Thermal Protective Performance (TPP) | | | | | |
| ISO 17492 TPP | TPP Rating** | 35.3 | | 35.3 | |

**Composite Materials: Glide w/PBI G2 Thermal Liner, Stedair Gold Moisture Barrier The present invention may be embodied in other forms without departing from the spirit and the essential attributes thereof, and, accordingly, reference should be made to the appended claims, rather than to the foregoing specification, as indicating the scope of the invention.

We claim:

1. A fabric for a thermal protective application comprises: 5-40 weight % PBI-p fiber with a denier per filament in the range of 1.0-2.0 and the balance being conventional fibers, the PBI-p fiber having an APU in the range of 4-30%, and APU is phosphoric acid pick up, where the fabric has equal or better flame-resistant and/or heat-resistant properties, a fabric weight less than an equivalent fabric made with a like amount of PBI-s fiber in place of the PBI-p fibers, and a Dynamic Flame property of at least 28% greater than the equivalent fabric.

2. The fabric of claim 1 wherein the fabric has a weight in the range of 1.0-6.5 ounces per square yard (osy).

3. The fabric of claim 1 wherein the thermal protective application include: fire fighter's turnout gear, tents, arc-flash protective gear, automotive applications, automotive gear, spacesuits, space vehicles, and electronic equipment.

4. The fabric of claim 1 wherein the fabric is woven, knitted, or non-woven.

5. The fabric of claim 1 wherein the conventional fibers are made of materials including: cotton, wool, polyolefin, polyamide, acrylic, polyester, aramid, cellulosic, carbon, polybenzoxazole, melamine, polyamide imide, polyimide, polyphenyl sulfide, polyflouride, poly ether ketone, and combinations and blends thereof.

6. The fabric of claim 1 wherein flame-resistant property includes: the Dynamic Flame; a Vertical Flame (ASTM D6413); a Thermal Protective Performance (NFPA1971/ISO17492); a Ball Burst (ASTM D3787) After TPP exposure (ISO17492); and combinations thereof.

7. The fabric of claim 1 wherein heat resistant property includes: a Thermal Shrinkage (ASTM F2894/ISO17493); and combinations therewith.

8. A fabric for a thermal protective application comprises: 5-40 weight % of a blend of PBI-p fiber with a denier per filament in the range of 1.0-2.0 and PBI-s fiber, and the balance being conventional fibers, the PBI-p fiber having an APU in the range of 4-30%, and APU is phosphoric acid pick up, the amount of PBI-s fiber being greater than the amount of PBI-p fiber, where the fabric has equal or better flame-resistant and/or heat-resistant properties, a fabric weight less than an equivalent fabric made with a like amount of PBI-s fiber in place of the PBI-p fibers, and a Dynamic Flame property of at least 28% greater than the equivalent fabric.

9. The fabric of claim 8 wherein the fabric has a weight in the range of 1.0-6.5 ounces per square yard (osy).

10. The fabric of claim 8 wherein the thermal protective application include: fire fighter's turnout gear, tents, arc-flash protective gear, automotive applications, automotive gear, spacesuits, space vehicles, and electronic equipment.

11. The fabric of claim 8 wherein the fabric is woven, knitted, or non-woven.

12. The fabric of claim 8 wherein the conventional fibers are made of materials including: cotton, wool, polyolefin, polyamide, acrylic, polyester, aramid, cellulosic, carbon, polybenzoxazole, melamine, polyamide imide, polyimide, polyphenyl sulfide, polyflouride, poly ether ketone, and combinations and blends thereof.

13. The fabric of claim 8 wherein flame-resistant property includes: the Dynamic Flame; a Vertical Flame (ASTM D6413); a Thermal Protective Performance (NFPA1971/ISO17492); a Ball Burst (ASTM D3787) After TPP exposure (ISO17492); and combinations thereof.

14. The fabric of claim 8 wherein heat resistant property includes: a Thermal Shrinkage (ASTM F2894/ISO174493); and combinations therewith.

* * * * *